US005405058A

United States Patent [19]

Kalis et al.

[11] Patent Number: 5,405,058

[45] Date of Patent: Apr. 11, 1995

[54] DEVICE FOR DISPENSING LIQUIDS

[76] Inventors: Russell A. Kalis, 8553 Quarles Rd., Maple Grove, Minn. 55311; Dennis C. Giesler, 6301 Quinwood La., Apt. #214, Maple Grove, Minn. 55369

[21] Appl. No.: 189,929

[22] Filed: Feb. 1, 1994

[51] Int. Cl.[6] ..... B67D 3/00

[52] U.S. Cl. ..... 222/185; 222/481.5

[58] Field of Search ..... 222/181, 185, 481, 481.5, 222/484

[56] References Cited

U.S. PATENT DOCUMENTS

| | | | |
|---|---|---|---|
| 223,396 | 1/1880 | Shabley | 222/481.5 X |
| 250,085 | 11/1881 | Lillis | 222/481.5 |
| 4,194,653 | 3/1980 | Brown | 222/402.25 |
| 4,260,074 | 4/1981 | Cerrato | 222/481.5 X |
| 4,386,718 | 6/1983 | Stewart et al. | 222/185 |
| 4,722,463 | 2/1988 | Anderson | 222/185 |
| 4,844,290 | 7/1989 | McCurdy et al. | 222/185 |
| 4,898,308 | 2/1990 | Rudick | 222/481.5 X |
| 4,911,334 | 3/1990 | Kedzierski | 222/185 |
| 5,079,013 | 1/1992 | Belanger | 222/481.5 X |
| 5,133,482 | 7/1992 | Burrows et al. | 222/185 |
| 5,211,314 | 5/1993 | Burrows | 222/185 |

FOREIGN PATENT DOCUMENTS

| | | | |
|---|---|---|---|
| 0340940 | 11/1989 | European Pat. Off. | 222/481.5 |

*Primary Examiner*—Andres Kashnikow
*Assistant Examiner*—Kenneth R. DeRosa
*Attorney, Agent, or Firm*—Janal M. Kalis

[57] ABSTRACT

The present invention includes a device for dispensing liquids that includes a main body having a mechanism for attaching to and sealing a liquid container, a vent on the main body for transferring air into the liquid container, and a mechanism for restricting air transferred through the vent to a threshold volume effective to substantially equalize pressure within the liquid container while preventing a transfer of vapor from the container.

2 Claims, 3 Drawing Sheets

DEVICE FOR DISPENSING LIQUIDS

BACKGROUND OF THE INVENTION

The present invention relates to a device and a method for dispensing liquids.

Liquids consumed by individuals as well as liquids used for industrial and agricultural purposes are commonly stored in bottles or other containers that are sealed with a cap. Aliquots of liquids are removed from the containers by removing the cap and transferring the aliquot out of the container. The liquid aliquot may be transferred by methods that include pouring the liquid out of the container and siphoning the liquid.

In many instances, storing liquids in a cap sealed container has wasted the liquids. In particular, the stored liquids have been wasted because the liquids degrade with repeated removal of the cap and removal of aliquots of the liquid.

Some liquids such as carbonated beverages degrade by losing carbonation and becoming flat tasting with repeated removal and replacement of the cap of the beverage container. The beverages lose carbonation because carbon dioxide escapes from the bottle when the cap is removed and the beverage aliquot is poured from the bottle. The escaped carbon dioxide had formed a head of carbon dioxide vapor over the beverage, pressurizing the beverage. When the cap is re-secured onto the bottle, an equilibrium of carbon dioxide concentration between a liquid beverage phase and the vapor phase is re-established within the bottle. This equilibrium is re-established when carbon dioxide is transferred from the liquid beverage phase to the vapor phase over the liquid beverage in order to compensate for a reduction in liquid volume in the bottle. When the bottle is opened again, the carbon dioxide in the vapor phase escapes from the bottle. The transfer of carbon dioxide from the liquid to the vapor and escape of carbon dioxide from the bottle causes the liquid beverage to become flat tasting.

Other liquids stored in sealed containers degrade as a consequence of contamination by airborne microbes that are introduced when the liquids are exposed to air by a removal of a bottle cap and by transferring liquid out of the container. These liquids include media for growing and maintaining cell lines. These liquids also include biodegradable liquid foods such as cranberry juice.

Brown, U.S. Pat. No. 4,194,653, describes a soft drink dispenser utilizing the vapor pressure of carbon dioxide of a carbonated beverage within a container for transferring the beverage out of the container. The dispensing device includes a valve having a main valve body with a valve seat, an adaptor for detachably coupling the valve to the container and an elongated tube in self sealing engagement with the adaptor. The valve also includes a valve stem movably mounted within a channel formed in the valve body and a discharge spout in communication with the channel.

In a rest position, the valve stem is positioned on the valve seat. The valve stem includes a face in contact with the valve seat that blocks soft drink flow in a rest position and that permits soft drink flow when a force is applied to the valve stem of the valve. The force causes the valve stem to compress a spring, positioned concentrically about the valve stem. The force and the resulting compression of the spring results in the valve stem face separating from the valve seat. The separation allows liquid in the container to be forced by the pressure of carbonation through the elongated tube and out a discharge spout. The device described in the Brown patent requires pressure from carbon dioxide to transfer liquid from the inside of the container to the outside.

One solution that limits the degradation of liquids including carbonated beverages, cell line growth media and liquid foods has included storing the liquids in containers having a size of one liter or less. This solution is based on an assumption that the cap of a smaller container will not be removed enough times to cause an excessive loss of carbon dioxide or to inoculate the liquid with an airborne microbe. This solution has, however, caused another problem of inefficient and wasteful use of materials used to make the large quantity of smaller containers.

SUMMARY OF THE INVENTION

The present invention includes a device for dispensing liquids that includes a main body having a mechanism for attaching to and sealing a liquid container, a vent on the main body for transferring air into the liquid container, and a mechanism for restricting air transferred through the vent to a threshold volume effective to substantially equalize pressure within the liquid container with an outside atmosphere and prevent an escape of vapor from the container.

DETAILED DESCRIPTION OF THE PREFERRED EMBODIMENTS

Figure 1:
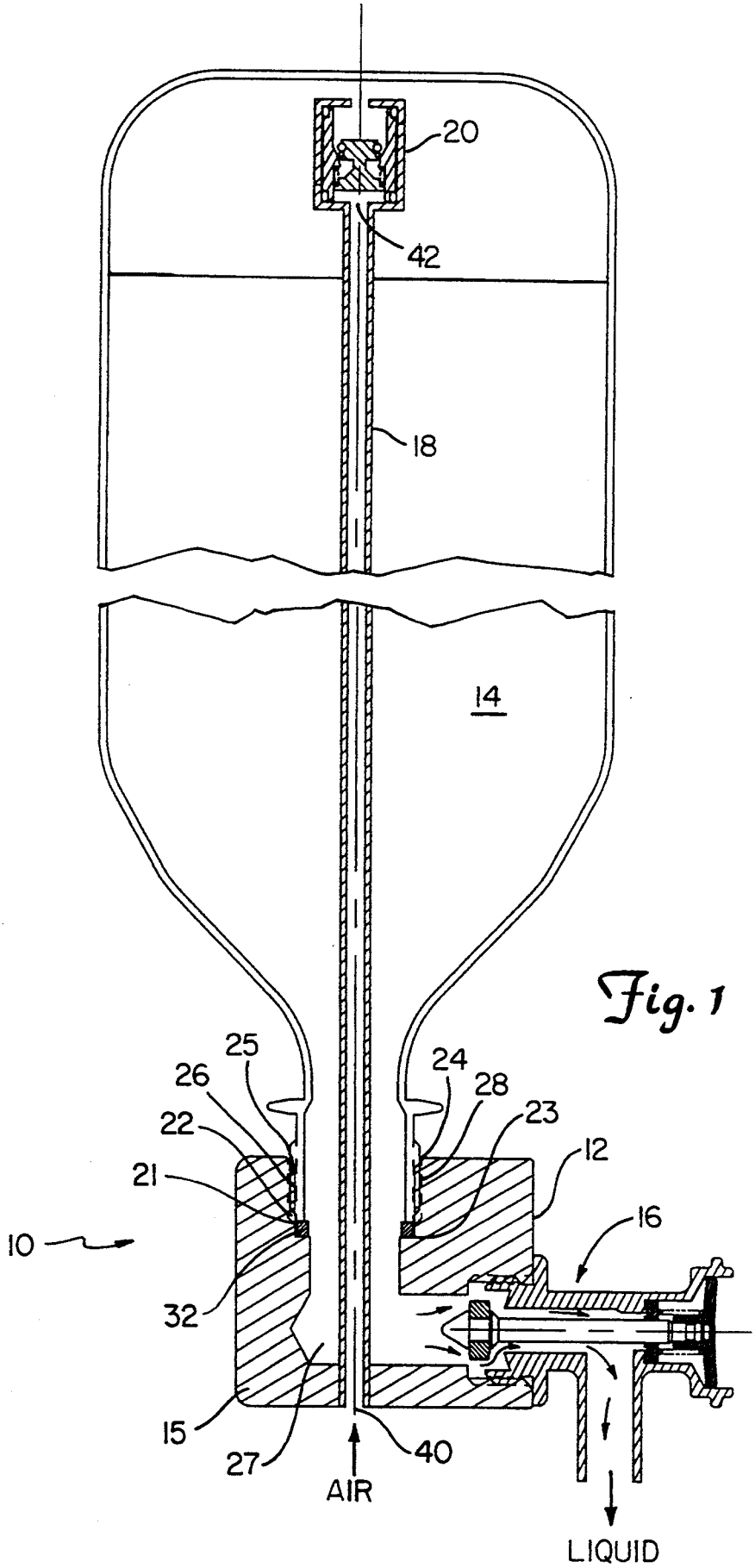
FIG. 1 is a cross-sectional view of one embodiment of a liquid dispensing device of the present invention.

The liquid dispensing device 10 of the present invention, illustrated generally in FIG. 1, includes a main body 12 having an orifice 27 and a capping portion 15 that is attachable to a container 14, a dispensing portion 16 for dispensing liquid from the container 14, a vent tube portion 18 attached to and extending out of the main body 12 through the orifice 27 and positioned in the container 14 for transferring air from outside the container 14 into the container 14 and a pressure regulating mechanism 20 positioned within the container 14 and attached to the vent tube portion 18. The present invention also includes a method for dispensing a liquid from a sealed container while maintaining a constant liquid composition and a substantially constant pressure on liquid remaining in the container that includes dispensing a volume of liquid from a sealed container, admitting a threshold quantity of air into the container sufficient only to substantially equalize pressure between the inside of the container and the atmosphere and blocking a transfer of gases, vapor and liquid from within the container to the atmosphere.

The liquid dispensing device 10 is a substantial improvement over existing dispensing devices because the pressure regulating mechanism 20 of the device 10 reacts substantially instantaneously and repeatedly to small changes in pressure within the container 14. Before the present invention, dispensing devices regulated pressure with components that tended to deform with use and tended to stick in a closed position. In order for these dispensing devices to open., the external atmosphere pressure had to exceed a combined force that included the chemical and mechanical forces causing the components to stick. As a consequence, an excess of air was released into the container and excessive vapor from the container escaped into the atmosphere.

Additionally, the liquid dispensing device 10 of the present invention is usable for dispensing a liquid from the container 14 having virtually any orientation, ranging from vertical to horizontal. Also, the liquid dispensing device 10 is usable for solving a variety of liquid degradation problems, ranging from a loss of carbonation to microbial contamination. The versatility is a consequence of a capacity of the device 10 to regulate a threshold amount of air admitted into the container to equalize pressure between the inside of the container 14 and the external atmosphere while preventing an escape of vapor, gases and liquid from within the container into the outside atmosphere. By "threshold amount of air" is meant a minimum quantity of air necessary to substantially equalize pressure between the inside of the container and the external atmosphere when a quantity of liquid is dispensed from the container 14. In particular, the device 10 admits only enough air to substantially equalize pressure and then prevents any further transfer of air into the container 14 or vapor, gases and liquid out of the container 14.

In one embodiment, the main body 12 of the dispensing device 10 is attachable to the container 14 at the capping portion 15 of the main body 12. The container 14 includes a neck 28, preferably threaded, that terminates in a rim 21. The capping portion 15 includes an annular wall 26 having threads 22 and a base 23 defining a socket 24. The socket 24 is sized to fit about the neck 28 of the container 14. The threads 22 of the annular wall 26 are compatible with threads 25 in the neck 28 of the container 14. The threads 25 and 22 of the container 14 and capping portion 15 act together to engage the neck 28 of the container 14 to the dispensing device 10. While a threaded capping portion 15 has been described, it is understood that the capping portion 15 may also include virtually any conventional embodiment for securing the dispensing device 10 to the container 14.

In one embodiment, the capping portion 15 is sealed to the threaded neck 28 of the container 14 by an annular elastomer body seal 32. The seal 32 rests on the base 23 of the capping portion 15. The rim 21 of the container 14 rests on the seal 32 once engaged by the dispensing device 10. The annular elastomer body seal 32 contacts the container 14 forming an air tight seal.

Containers attachable to the dispensing device 10 include the bottle-type container 14, illustrated in FIG. 1, having a neck 28 that can be opened and closed to the atmosphere by attaching and removing the capping portion 15. The device 10 of the present invention is usable on virtually any resealable container, however. The device 10 is also usable on containers having a wide range in volume, including containers holding at least two liters of a liquid.

The vent tube 18 is positioned in the orifice 27 of the main body portion 12. The vent tube 18 includes a first open end 40 and a second open end 42 opposing the first open end 40. The second open end 42 terminates in the pressure control mechanism 20 and is positioned within the container 14. The first open end 40 opens to the atmosphere, outside of the container 14. The vent tube 18 is preferably made of a stiff, light weight material such as polypropylene. The vent tube 18 is attached to the main body 12 by a conventional mechanism that includes glue, other adhesive or a mechanical bond. The attachment of the vent tube 18 to the main body must be substantially airtight and must be able to withstand a difference in pressure between the inside of the container 14 and the outside of the container 14.

Figure 2:
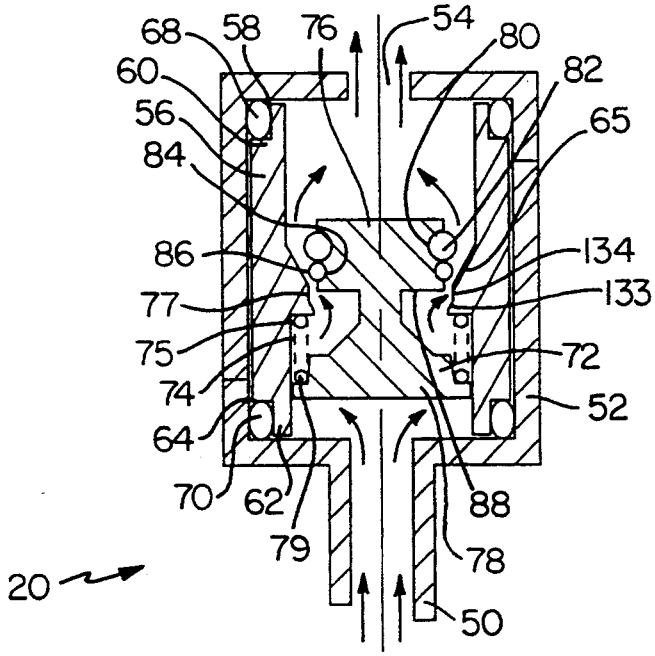
FIG. 2 is a cross-sectional view of one embodiment of a pressure regulating mechanism of the liquid dispensing device in an open position.

Preferably, the pressure control mechanism 20, illustrated in cross section in FIG. 2 includes an annular air inlet segment 50 and a housing 52 integral to the air inlet segment 50. The housing encloses an orifice 54. An annular valve body 56 having an upper end 58 with an upper annular surface 60, a lower end 62 with a lower annular surface 64 and a shoulder 65 positioned integrally between the upper end 58 and the lower end 62 is positioned within the housing 52. The shoulder 65 includes a shoulder surface 77. The shoulder surface 77 includes a shoulder seal contact surface 133 that includes an indentation 134 with respect to the shoulder surface 77.

An upper O-ring 68 rests on the upper annular surface 60 and a lower O-ring 70 contacts the lower annular surface 64. The O-rings 68 and 70 each seal the annular valve body 56 and the housing 52. While O-rings have been described, it is understood that other conventional types of sealing devices are suitable for use.

A poppet 72, positioned within the annular valve body 56, includes an upper portion 76 and a lower portion 78 that is integral with the upper portion 76. The poppet 72 is in communication with the valve body 56 by a spring 74. The spring 74 includes an upper end 75 in contact with the shoulder 65 and a lower end 79 in contact with the lower portion 78 of the poppet 72. In one preferred embodiment, the spring 74 retains the poppet 72 over the air inlet segment 50 with a force substantially equivalent to a load of about three inches of water. At a pressure difference of about three inches of water between the interior of the container 14 and the external atmosphere, the spring 74 is compressed by atmospheric pressure.

The upper portion 76 of the poppet 72 includes an annular retaining ring surface 80 and a retaining ring 82 that is in contact with the retaining ring surface 80. The upper portion 76 of the poppet 72 also includes an O-ring surface 84 and an O-ring 86 in contact with the O-ring surface 84. The O-ring 86 is positioned below the retaining ring 82.

The lower portion 78 of the poppet includes a substantially flat bottom surface 88. The lower portion 78 of the poppet 72 has a maximum cross-sectional length at the bottom surface 88. The maximum cross-sectional length of the bottom surface 88 is less than an inner diameter of the valve body 56. Consequently, when the bottom surface 88 is positioned above the air inlet 50, air from the atmosphere may pass around the bottom surface 88.

Figure 3:
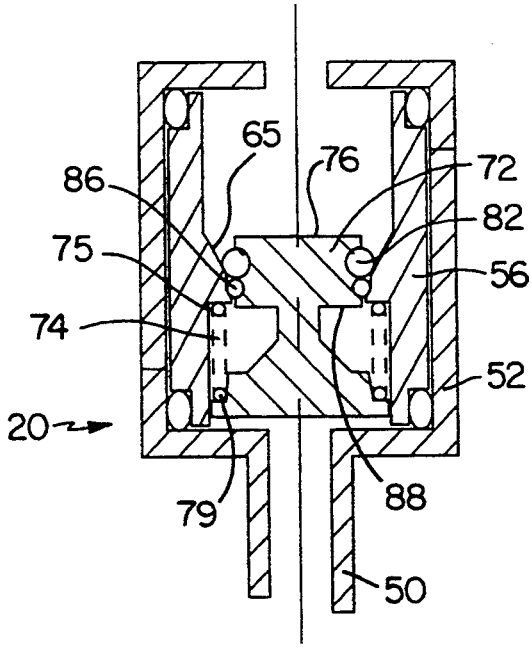
FIG. 3 is a cross-sectional view of one embodiment of the pressure regulating mechanism of the liquid dispensing device in a closed position.

The popper 72 has either an open position, illustrated in FIG. 2 or a closed position, illustrated in FIG. 3 within the valve body 56, depending upon pressure exerted on the bottom surface 88. The closed position occurs when the pressure exerted on the bottom surface 88, air pressure, is less than the combination of pressure exerted on the upper portion 76 of the poppet 72 by the pressure within the container 14 and the load of the spring 74 on the bottom surface 88, about three inches of water in one embodiment. In one embodiment of the closed position, the bottom surface 88 contacts the housing 52. It is also contemplated, however, that the bottom surface 88 be positioned above the housing 52, in other closed position embodiments. For all closed position embodiments, however, the spring 74 is distended.

In the closed position, the retaining ring 82 of the upper poppet portion 76 rests on the shoulder 65 of the valve body 56. The O-ring 86 contacts the shoulder seal contact surface 133. The shoulder seal contact surface 133 is indented to a degree that causes the O-ring 86 to be under slight compression between the poppet 72 and valve body 56. When compressed, the O-ring 86 deforms. When the O-ring 86 contacts the shoulder seal contact surface 133 and deforms, the O-ring 86 seals the atmosphere within the container 14 and prevents a transfer of gas, vapor and liquid to the outside atmosphere.

In the open position, illustrated in FIG. 2, the pressure of the air is greater than the combined load of the spring 74 and the pressure of vapor inside the container 14. As a consequence, the bottom surface 88 of the poppet 72 is lifted upward, away from the housing 52. The spring 74 is compressed. The retaining ring 82 and O-ring 86 of the upper poppet portion 76 are lifted away from the shoulder 65. As a consequence, air is transferred to the orifice 54 of the mechanism 20 and then into the container 14 from the outside atmosphere. The transfer of air continues until the air pressure is substantially equal to a combined pressure of vapor within the container acting on the upper poppet portion 76 and O-ring 86 and the force of the spring 74 acting on the lower poppet portion 78. Once this condition is reached, the poppet 72 is biased downward by the spring 74. In one embodiment, the poppet 72 contacts the valve body 56 as shown in FIG. 3. The retaining ring 82 contacts the shoulder 65 of the annular valve body 56 and the O-ring 86 is positioned to contact the shoulder seal contact surface 133. Once positioned, the O-ring 86 is compressed and deforms thereby sealing the mechanism 20.

The pressure control mechanism 20 is able to react substantially instantaneously to pressure reductions within the container 14 because the combination of the retaining ring 82 and O-ring 86 seal the upper portion 76 of the poppet 72, thereby sealing the container 14. With the combination, the retaining ring 82 is positioned to contact the shoulder 65 and restrain the poppet 72 from movement. To minimize deformation over repeated openings and closings of the mechanism 20, the retaining ring 82 is made of a relatively hard material, such as stainless steel or other comparable material.

The O-ring 86 provides the seal and deformably contacts the shoulder surface 77 at the shoulder seal contact surface 133. By decoupling the functions of retaining the poppet 72 within the annular valve body 56 and sealing the air inlet segment 50, separate components are provided that optimize performance of each function. The retaining function is performed by the hard, nondeformable retaining ring 82. The sealing function is performed by the softer, more malleable O-ring 86. Over time then, neither the O-ring 86 nor the retaining ring 82 substantially permanently deform or stick to the valve body 56. As a consequence, excess air is not added to the container 14.

Figure 4:
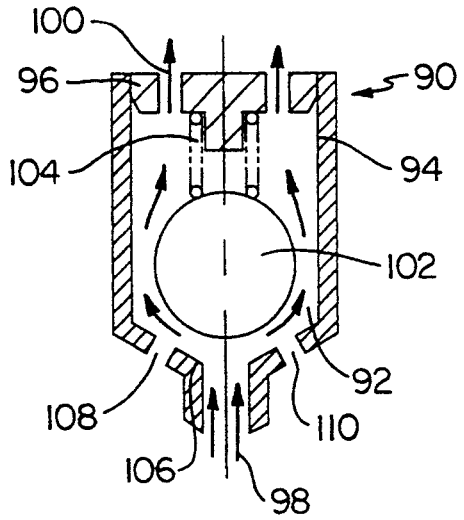
FIG. 4 is a cross-sectional view of one other embodiment of the pressure regulating mechanism of the liquid dispensing device.
Figure 5:
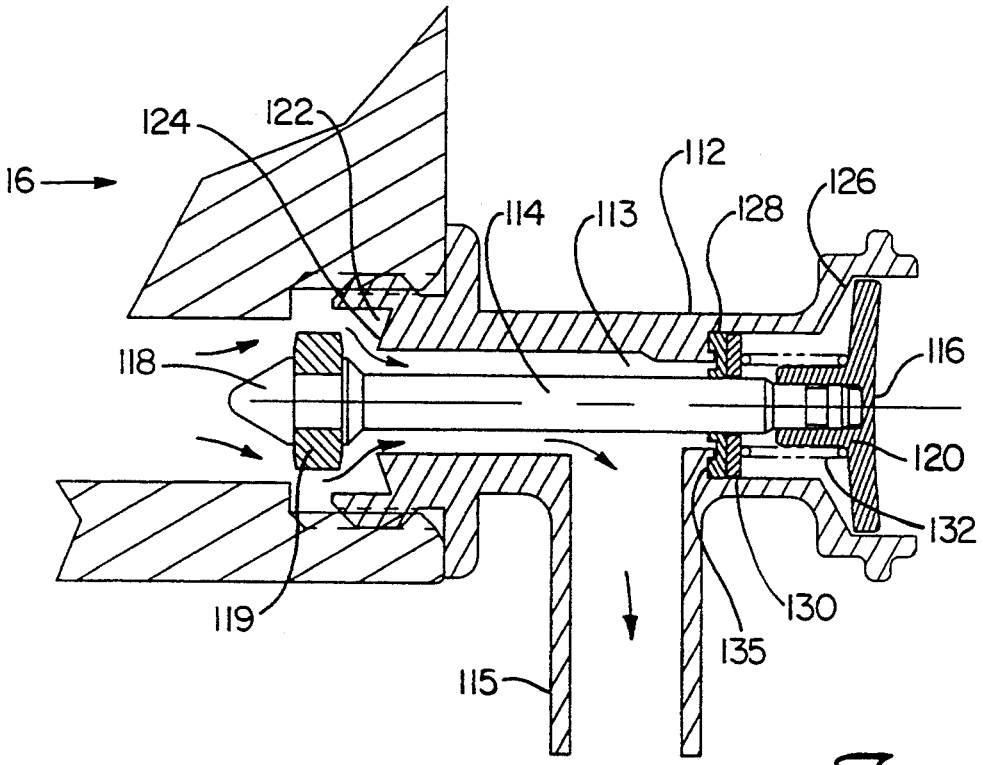
FIG. 5 is a cross-sectional view of one embodiment of the dispensing portion of the liquid dispensing device of the present invention.

One other embodiment of the pressure control mechanism 90, as illustrated in FIG. 4, is a ball-type mechanism. The ball-type mechanism 90 includes a chamber 92 enclosed by an annular wall 94 and a cap 96 conjoined to the annular wall 94. The mechanism 90 also includes an inlet opening 98 integral to the second open end 42 of the vent tube 18, an outlet 100 in communication with atmosphere enclosed by the container 14, a ball 102 positioned within the chamber 92 and a spring 104, also positioned within the chamber 92 and in contact with the cap 96. The annular wall 94 is attached to the vent tube 18 at the inlet opening 98. Preferably, the wall 94 is curvedly tapered, forming an annular shoulder 106, to meet the vent tube 18. In a closed position, the ball 102 rests on the shoulder 106, thereby covering the vent tube 18 and blocking any transfer of vapor, gas, or liquid between the inside of the container 14 and the outside of the container 14.

The shoulder 106 of the annular wall 94 includes openings 108, and 110 for equalizing pressure between the chamber 92 and the atmosphere within the container 14. The annular wall 94 is of a height to prevent the ball 102 from escaping when pressure inside of the container 14 is reduced to a pressure below the atmosphere.

The annular wall 94 conjoins the cap 96, substantially perpendicular to the annular wall 94. The cap 96 includes the outlet 100 that vents gas and vapor transferred from the atmosphere to the container when the ball 102 is lifted.

When the dispensing device 10 is in a closed nondispensing position, the ball 102 is positioned on the annular shoulder 106, over the inlet opening 98 and covers the inlet opening 98. The ball 102 is held in place by the spring 104 that applies a tension upon the ball 102 and holds the ball 102 in a position covering the second open end 42 of the vent tube 18. The ball 102 is most preferably made of a light weight material.

The spring 104 holds the ball 102 over the inlet opening 98 with a force substantially equivalent to a load of about three inches of water. At a pressure difference of about three inches of water between the interior of the container 14 and the external atmosphere, the spring 104 is compressed by vapor pressure acting on the ball.

When liquid is dispensed from the container 14, the ball 102 is displaced from its position over the inlet opening 98 by a pressure difference that compresses the spring 104. The displacement of the ball 102 opens the inlet opening 98 and air enters the container 14 through the vent tube 18. Air enters the container 14 until the atmospheric pressure is substantially equal to the pressure in the container 14.

The dispensing valve portion 16 of the dispensing device 10 includes a tube 112 that opens into the socket 24 of the main body 12, a spool 114 positioned within the tube 112, and an outlet port 115 perpendicular to and integral with the tube 112. The spool 114 has a diameter that is substantially less than the tube 112 so that when the spool 114 is installed in the tube 112, the spool 114 leaves a substantial annular opening 113 between the spool 114 and an inner annular wall 122 of the tube 112.

The spool 114 includes a pushable end 116 and a tapered releasable end 118 opposing the pushable end 116. The pushable end 116 and tapered releasable end 118 of the spool 114 face the outside of the dispensing device 10. The spool 114 also includes a first sealing ring 119 that is proximate to the tapered releasable end 118.

The pushable end 116 includes a button 120 that is attached to the pushable end 116. The pushable end 116 also includes a washer 130 and a second sealing ring 128. The second sealing ring 128 is positioned between the washer 130 and the tapered releasable end 118. The second sealing ring 128 prevents fluid from escaping around the pushable end 116 of the spool 114. The second sealing ring 128 provides a seal between the spool 114 and the tube 112.

The inner annular wall 122 of the tube 112 includes an annular releasing shoulder 124, an annular pushable end shoulder 126 and a retaining shoulder 135 proximal to the pushable end shoulder 126. The sealing ring 128 rests against the retaining shoulder 135, thereby forming a seal. A spring 132 is positioned between the washer 130 and the button 120. The spring 132 forces the washer 130 against the seal 128 for all dispensing device 10 positions. The releasing shoulder 124 retains the spool 114 at the first sealing ring 119 when the dispensing portion 16 is in a closed position.

The spool 114 is longitudinally movable to the closed position where the first sealing ring 119 away of the tapered releasable end 118 rests on the releasing shoulder 124, forming a seal. In the closed position, liquid is prevented from flowing out of the container 14 by the first sealing ring 119, resting on the releasing shoulder 124.

The spool 114 is also longitudinally movable to a position where the button 120 is pushed laterally, compressing the spring 132 and displacing the first sealing ring 119 from the releasing shoulder 124. This is an open position. In the open position, the first sealing ring 119 is moved away from the releasing shoulder 124 by a lateral push of the button 120. When the first sealing ring 119 is moved away, liquid within the container 14 has a flow path through the socket 24 of the dispensing device 10, the annular space 113 within the tube 112 of the dispensing portion 16 and out the outlet port 115. The flow of liquid is evenly directed within the annular space 113 of the tube 112 by the tapered releasable end 118.

In use, the dispensing device 10 of the present invention includes a liquid dispensing mode and a liquid storage mode. In the liquid dispensing mode, the spool 114 is positioned so that the button 120 is pushed laterally, compressing the spring 132 and displacing the first sealing ring 119 from the releasing shoulder 124. In this position, liquid from the container 14 is free to pass out of the container 14. The passage of liquid out of the container 14 results in a reduction of liquid volume in the container 14. The reduction in liquid volume within the container 14 increases the volume of gases and vapors in the container 14. An increase in gas and vapor volume with no substantial increase in gas and vapor mass results in a pressure drop in the container 14. Thus, the pressure in the container 14 will be less than atmospheric pressure.

The pressure on the flat bottom surface 88 of the poppet 72 of the pressure regulating mechanism 20 includes the tension exerted by the spring, about three inches of water, and the pressure exerted from the interior atmosphere of the container 14 onto the poppet 72. When the pressure exerted from the container 14 drops, as occurs when liquid is dispensed from the container 14 the poppet 72 is displaced upward. Consequently, the O-ring 86 is displaced from contact with the shoulder seal contact surface 133. When the O-ring 86 is displaced, air is transferred from the vent tube 18 into the container 14 by passage across the pressure regulating mechanism 20. When the pressure from the outside atmosphere displacing the O-ring 86 the poppet 72 is substantially equal to the pressure within the container 14 and tension of the spring 74 applied to the poppet 72, the poppet 72 is displaced downward. The O-ring 86 is positioned in contact with the seal contact surface 133 and deforms thereby blocking any further transfer of air.

Only enough air is transferred to compensate for the quantity of liquid dispensed in a manner that substantially equalizes pressure within the container 14 and outside of the container 14. The transfer occurs in a manner that substantially prevents vapor, gas and liquid from escaping from the container 14. Air is not transferred once the pressure regulating mechanism 20 has substantially equalized the pressure.

Although the present invention has been described with reference to preferred embodiments, workers skilled in the art will recognize that changes may be made in form and detail without departing from the spirit and scope of the invention.

What is claimed is:

1. A device for dispensing liquids, comprising:

a main body having means for attaching to and sealing a liquid container that contains vapor, gases and liquid;

a vent on the main body for transferring air into the liquid container; and a mechanism for restricting air transferred through the vent to a threshold volume effective to substantially equalize pressure within the liquid container and prevent an escape of vapor, gases and liquid from the container wherein the mechanism for restricting air comprises:

a valve body having an inlet in communication with the vent, an outlet in communication with the liquid container, a chamber in communication with the inlet and outlet with a movable body within the chamber wherein the movable body includes a first substantially nondeformable annular retaining ring positioned on the movable body, a second deformable annular seal ring positioned on the movable body wherein the nondeformable retaining ring secures the movable body to the valve body and the deformable seal ring seals the inlet; and a mechanism for imposing a tension upon the movable body that positions the movable body in a first position over the inlet, blocking the inlet.

2. The device of claim 1 wherein the mechanism for imposing a tension on the movable body is a spring acting on the movable body and the valve body.

* * * * *